US006811621B1

(12) United States Patent
Fukada

(10) Patent No.: US 6,811,621 B1
(45) Date of Patent: Nov. 2, 2004

(54) MEMBER OF AIR MOTOR

(75) Inventor: Kazunori Fukada, Yamaguchi (JP)

(73) Assignee: Kohan Kogyo Co., Ltd., Yamaguchi (JP)

( * ) Notice: Subject to any disclaimer, the term of this patent is extended or adjusted under 35 U.S.C. 154(b) by 0 days.

(21) Appl. No.: 09/830,645

(22) PCT Filed: May 31, 1999

(86) PCT No.: PCT/JP99/02885

§ 371 (c)(1),
(2), (4) Date: Dec. 3, 2001

(87) PCT Pub. No.: WO00/24945

PCT Pub. Date: May 4, 2000

(30) Foreign Application Priority Data

Oct. 28, 1998 (JP) ..... 10/321380

(51) Int. Cl.[7] ..... C23C 8/38
(52) U.S. Cl. ..... 148/318
(58) Field of Search ..... 148/217, 318

(56) References Cited

U.S. PATENT DOCUMENTS 3,767,335 A * 10/1973 Kramer et al. ..... 418/259
5,488,263 A * 1/1996 Takemura et al. ..... 313/402

OTHER PUBLICATIONS

"Plasma (Ion) Nitriding" from ASM Handbook vol. 4, Heat Treating, pub. by ASM International, Jun. 1995, pp. 420–424.*

JIS G 4105–1979.*

English translation of JP 55–041940 A.*

Abstract of Patent No.: JP55041940, Title: Ion Sulphurizing and Nitriding Method, Publication date: Mar. 25, 1980, Inventor: Kojima Yoshiyuki, Applicant: Hitachi Ltd.

Abstract of Patent No.; EP0852294, A3, Title: Variable capacity swash plate compressor and method of surface treatment of a swash plate thereof, Publication date: Jul. 8, 1998, Inventor(s): Saito Tadashi (JP); Tokumasu Hiroshi (JP), Applicant: Zexel Corp (JP).

* cited by examiner

*Primary Examiner*—Roy King
*Assistant Examiner*—Harry D. Wilkins, III
(74) *Attorney, Agent, or Firm*—Browdy and Neimark, P.L.L.C.

(57) ABSTRACT

This invention intends to provide a long life member for air motors (rotor cylinder material, front cylinder cover material, rear cylinder cover material or the like) having more greater and uniform Vickers hardness than usual and excellent in abrasion resistance, shock resistance and thermal impact resistance. For this purpose, in this invention, a contact surface of a vane-surrounding member with vanes is heated at 450 to 580° C. in the mixed gas atmosphere comprising 50 to 95% of hydrogen, and 5–50% of nitrogen and 0.01 to 99 parts by volume of hydrogen sulfide based on 100 parts by volume of nitrogen, a DC voltage at 300 to 500 V is applied relative to an anode disposed in a vacuum chamber and a nitrosulphurization layer having mean value for the Vickers hardness of 800 to 1200 with a larger difference between the mean value and the maximum value or the minimum value being 100 or less, is formed on the surface of contact with the vanes by using a bright nitrogen diffusion method.

7 Claims, 8 Drawing Sheets

MEMBER OF AIR MOTOR

REFERENCE TO RELATED APPLICATIONS

The present application is the national stage under 35 U.S.C. §371 of international application PCT/JP99/02885, filed 31 May 1999 which designated the United States, and which application was not published in the English language.

TECHNICAL FIELD

This invention concerns a vane-surrounding member of an airmotor. More specifically, it relates to a rotor, a cylinder, a front cylinder cover, a rear cylinder cover or the like in contact with a vane type air motor, applied with a surface treatment by using a bright nitrogen diffusion method.

BACKGROUND ART

Vane type air motors are simple and convenient to handle with and have been generally used for such application uses as small-sized clamping apparatus. Particularly, since they have an advantage of being usable conveniently in a working circumstance which may cause danger upon occurrence of electric sparks so long as a high-pressure air source is available, without using an explosion proof motor.

Vanes made of die steels or high speed steels have been used so far for the vanes of the air motors but, since motor vane rotate at a high speed, the surface of vane-surrounding members undergo repetitive contact with the vanes and, as a result, tends to cause defects such as abrasion, injury or scorching. Accordingly, in the existent vane-surrounding members for the air motors, quenching/tempering, nitridation and soft nitridation for surrounding members have been applied and, further, oil-feeding operation such as of turbine oils has been indispensable for preventing occurrence of such defects.

However, since the hardness on the surface of the vane-surrounding members is insufficient or nitrogen compounds constituting the nitridation layer tend to be defoliated in the treatment, the working life of the vane-surrounding members is extremely short and the productivity is poor since the conditions for manufacturing the nitridation layer are difficult. Further, while surrounding members comprising super hard alloys may also be used in addition to the die steels or high speed steels described above, they are expensive as the material for the members and, in addition, involve a problem that they are more fragile compared with the die steels or high speed steels, so that they involve inconvenience that they can not be applied to products having thin or complicated shapes, for which improvement has been demanded. Further, as industrial situations, manual oil feeding operation has been disliked and oilless motors not requiring oil feeding operation has been demanded in recent years in view of circumstantial sanitation.

In view of the foregoing situations, this invention has a subject of providing a long life vane-surrounding member for air motors excellent in abrasion resistance, impact resistance and thermal shock resistance having higher hardness for the surface of the vane-surrounding member than usual.

DISCLOSURE OF THE INVENTION

A member for air motors defined in claim 1 has a feature in which a surface is heated to 450 to 580° C. in a mixed gas atmosphere comprising 50 to 95% of hydrogen, and 5 to 50% of nitrogen and hydrogen sulfide, a DC voltage at 300 to 500 V is applied relative to an anode disposed in a vacuum chamber, and a nitrosulphurization layer is formed on the surface by using a bright nitrogen diffusion method.

A member for air motors defined in claim 2 has a feature in which the nitrosulphurization layer has a hardness of 800 to 1200 Vickers hardness (load: 100 gf).

A member for air motors defined in claim 3 has a feature in which the ratio of nitrogen and hydrogen sulfide in the gas mixture is from 0.01 to 99 parts by volume of hydrogen sulfide based on 100 parts by volume of the nitrogen content.

A member for air motors defined in claim 4 in which the member is one or more of rotors, cylinders, a front cylinder covers or rear cylinder covers.

BEST MODE FOR CARRYING OUT THE INVENTION

In this invention, it has been found that a long life vane-surrounding member for air motors excellent in abrasion resistance, impact resistance and thermal shock resistance can be obtained by ionically nitrosulphurizing the surface of a surrounding member in contact with vanes by using a bright nitrogen diffusion (hereinafter referred to as plasma nitrosulphurization) method of conducting glow discharge in a mixed gas atmosphere of hydrogen gas, nitrogen gas and hydrogen sulfide at a high temperature under a reduced pressure, and forming a nitrosulphurization layer (hereinafter referred to as plasma nitrosulphurization layer) having higher and more uniform hardness than usual and excellent in adhesion with a steel matrix layer because of the uniform hardness.

Figure 1:
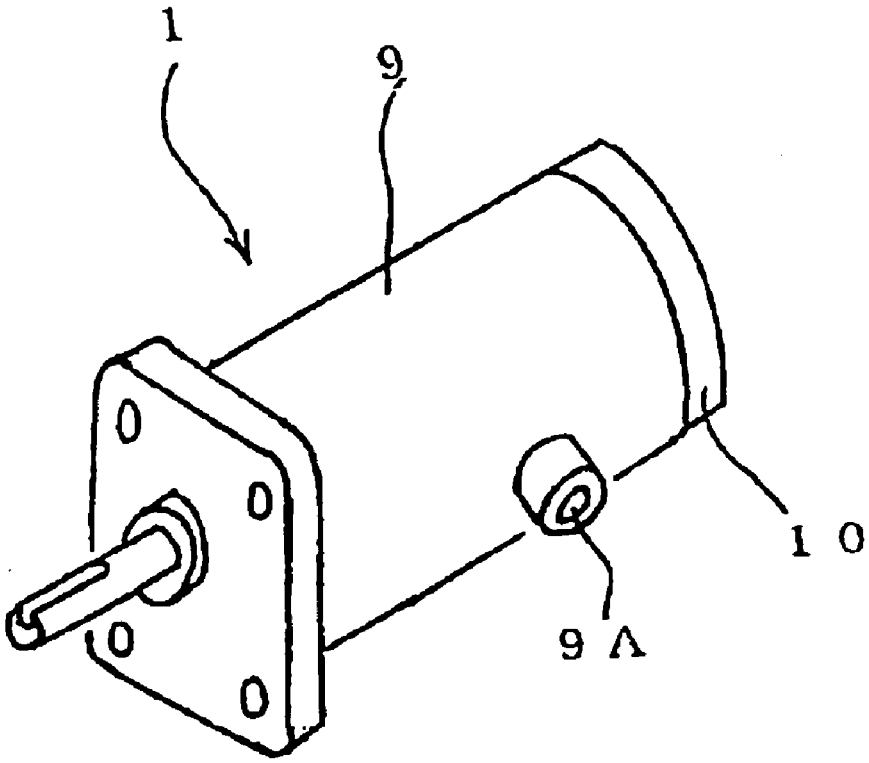
FIG. 1 is an example of an outer looking view of a vane type motor according to an embodiment of this invention.
Figure 2:
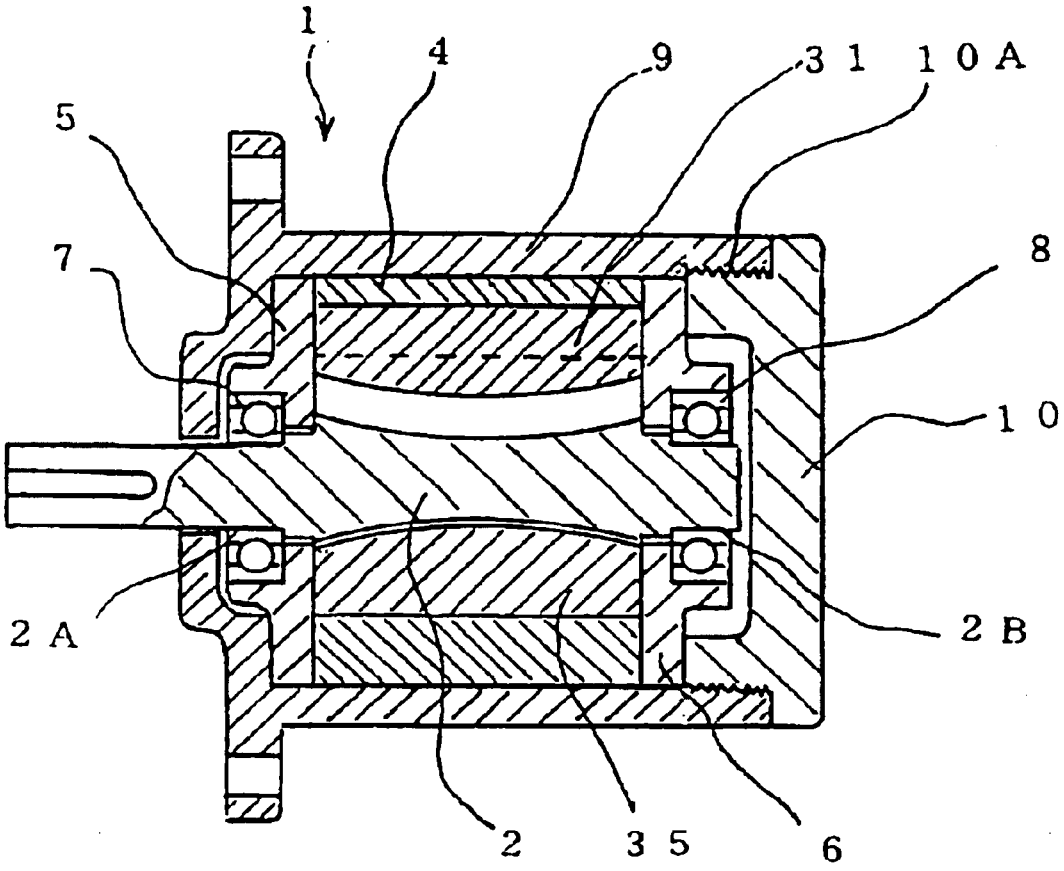
FIG. 2 is a perspective view illustrating the structure of a rotor portion in the inside of a vane type motor according to the embodiment of this invention.

FIG. 1 is an outer looking of a vane type air motor in which the periphery of the motor is surrounded with a motor case 9 and an end cover 10, and an air supply hole 9A is provided to a motor case outer wall. FIG. 2 is a transversal cross sectional view illustrating the structure in the inside of the air motor in which a rotor 2 present at the center of the motor is disposed in the vicinity of an inner wall 4D of a cylindrical hole 4C fabricated at an eccentrical position of a cylinder 4. Shafts 2A and 2B on both ends of the rotor 2 are supported by bearings 7 and 8 fitted to a front cylinder cover 5 and a rear cylinder cover 6, respectively, disposed on both sides of the rotor 2 and the cylinder 4.

Further, the cylinder 4, the front cylinder cover 5, and the rear cylinder cover 6 are fitted in the cylindrical hole 9C of the motor case 9 and secured at a threaded portion 10A of the end cover 10. The inner wall of the cylinder 4 is disposed on the side of the cylinder in the inside of the motor case 9, in which vanes 31 and 35 are accommodated.

Figure 3:
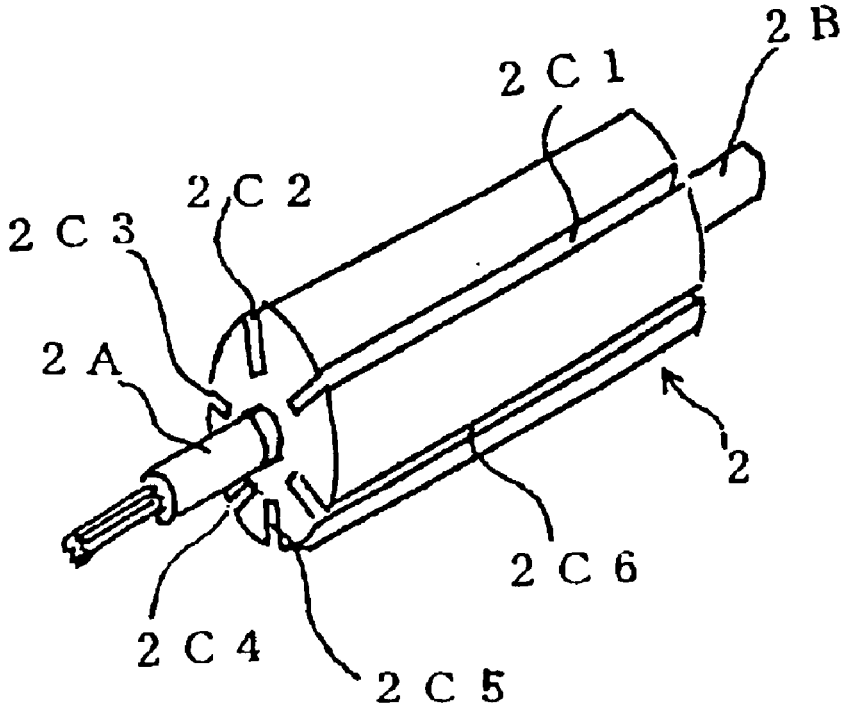
FIG. 3 is a transversal cross sectional view for a rotor portion in the inside of the vane type motor according to the embodiment of this invention.

FIG. 3 shows a structure only for the rotor portion in which a rotor 2 is coupled between the shafts 2A and 2B on both ends, and the rotor 2 is supported by the bearings 7, 8 fitted respectively to the front cylinder cover 5 and the rear cylinder cover 6 in FIG. 2. A plurality of radially fabricated grooves 2C1–6 is recessed to the rotor 2 and vanes 31–36 not illustrated here are disposed in the grooves.

Figure 4:
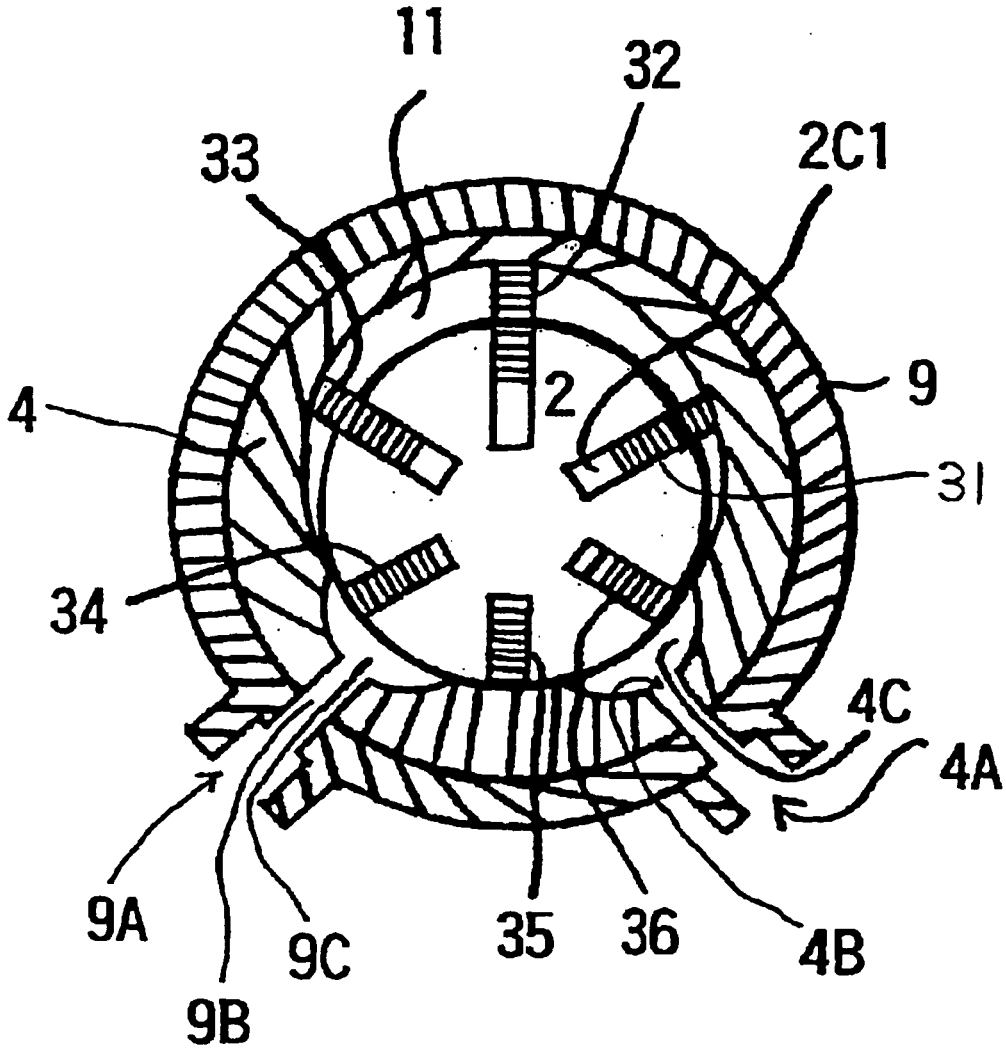
FIG. 4 is a transversal cross sectional view, as viewed from an orthogonal direction, of a rotor portion of the vane type motor according to the embodiment of this invention.

FIG. 4 is a transversal cross sectional view for the plane of the rotor as viewed from the orthogonal direction in which a vane 31 is buried in the groove 2C1 formed to the surface of the rotor 2 and, in the same manner, vanes 32–36 are disposed slidably in other grooves (2C2–2C6), and the vanes 31–36 move slidingly along the radial direction in the grooves 2C1–6 in accordance with the rotation of the rotor 2.

As apparent from FIG. 4, the rotor 2 is disposed eccentrically in the cylinder to form a vacant hole 11 relative to the inner wall of the cylinder 4.

A feeding air chamber 4C and an exhausting air chamber 9C are formed to the portion of the inner wall of the cylinder 4, in which the air chambers 4C and 9C are in communication with an air feed hole 4A or air exhaust hole 4B perforated through the cylinder and, further, the air feed hole 4A is in communication with an air feed hole 4A disposed to the motor cases outer wall 9. Further, in the same manner, the air exhaust hole 4B is in communication with an air exhaust hole 9A disposed to a motor case outer wall 9. A switching valve, not illustrated, is appended such that the rotation of the motor vanes is possible in any of right and left directions. Accordingly, if the rotation of the motor vanes is reversed, the air intake/exhaust relation is reversed.

Now, a high-pressure air is fed through the air feed hole 9A to rotate motor vanes counterclockwise in FIG. 4. When air is intaken from the air feed port 9A by way of the air feed port 4A of the cylinder 4 and into the air chamber 4C in the cylinder 4 and exerts on the vane 31, the rotor 2 rotates undergoing the counterclockwise rotational force. The air stream causes the rotor 2 to rotate by the moving operation of the air chamber 4A, the vacant hole 11 and the vanes and pressurized air is finally exhausted by way of the exhaust port 4B of the cylinder 4 from the exhaust port 9B of the motor case into atmospheric air. In this way, the motor 2 continuously rotates counterclockwise.

In this case, the rotor 2 rotates at 10,000 rpm undergoing a pressure of 500 KPa. Accordingly, unless turbine oil or the like is supplied, the surrounding members of the vanes suffer from early abrasion or scorching to cause troubles such as incapability of rotation or lowering of performance.

Figure 5:
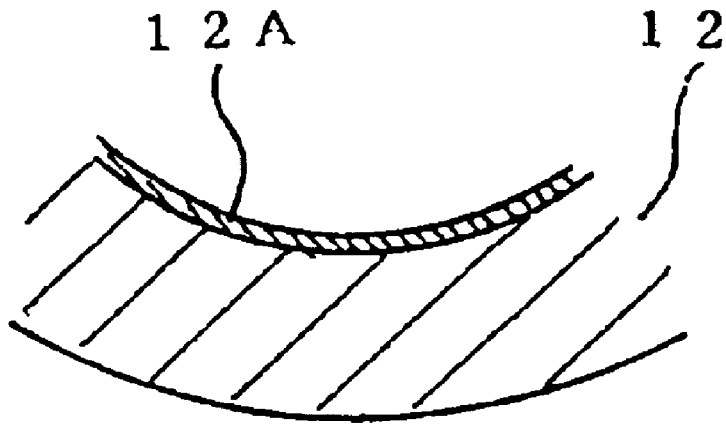
FIG. 5 is a cross section view illustrating a portion formed with nitridation layer for a portion of a cylinder inner wall as a surrounding member of the vane type motor according to the embodiment of this invention.

FIG. 5 is a cross sectional view illustrating an example of a surrounding member in which a member 12 is abraded by frictional contact with the motor vane and, if left as it is, embrittled and finally ruptured. Therefore, a plasma nitrosulphurization layer 12A at a thickness of about 30 to 300 $\mu$m is formed on the surface of members in contact with the motor vanes.

Since the surrounding members for the motor vanes of this invention are made of cast material or forged material, it is preferred to apply the plasma nitrosulphurization to quenched/tempered die steels but the use of the die steels is not restrictive and structural steels, cast hardening steels, spring steels, high speed steels or stainless steels may also be used depending on the application uses and, heat treatment such as quenching/tempering before the plasma nitrosulphurization may be saved depending on the case.

Then, a method of forming the plasma nitrosulphurization layer to the uppermost surface of the surrounding member of this invention is to be explained.

A necessary portion of the surrounding member made of SKD61 steels subjected to degreasing cleaning by an organic solvent or the like is placed on a support disposed in a vacuum chamber and, after evacuating the inside of the vacuum chamber to about $10^{-3}$ torr, heated at 450 to 580° C. in an atmosphere comprising 50 to 95% of hydrogen and a gas mixture containing 5 to 50% of nitrogen and 0.01 to 99% by volume of a hydrogen sulfide gas based on 100 parts by volume of the nitrogen gas, and a DC voltage at 300 to 500 V is applied relative to an anode disposed in the vacuum chamber to ionize the gas by glow discharge and nitrogen is diffused to the surface of the surrounding member. The processing time is about 1 to 30 hours and then the member is left to be cool in a nitrogen atmosphere or by reducing pressure.

Further, in this invention, the plasma nitrosulphurization has to be applied by heating the member to be treated to a temperature of 450 to 580° C. Because if it is lower than 450° C., the plasma nitrosulphurization reaction is extremely slow and on the other hand, if it exceeds 580° C., once formed nitrosulphurization products are decomposed and the plasma nitrosulphurization reaction proceeds no more. As the heating means, electric heating or gas heating may be used. The heating source may be disposed in the vacuum chamber or the outside thereof for conducting the ionic nitrosulphurization and programmed temperature elevation or temperature keeping can be controlled automatically when used in combination with an automatic control system.

As a gas for plasma nitrosulphurization, a gas mixture of a hydrogen gas and a nitrogen gas and a hydrogen sulfide gas is used. In this case, when a gas mixture in which 0.01 to 99 parts by volume of a hydrogen sulfide gas is mixed with 100 parts by volume of a nitrogen gas is used, a nitrosulphurization layer having stable and uniform hardness can be formed. Further, the hydrogen gas acts as an auxiliary gas for stably ionizing the gas mixture of the nitrogen gas and the hydrogen sulfide gas.

The $N_2/H_2$ volume ratio is 1:100–1:0, preferably, 1:10–2:1. If it is less than 1:100, plasma nitriding reaction is not sufficient. Further, an inert gas such as Ar, Ne or He gas can be added for making the surface hardness uniform so as to make the thickness and the hardness of the film uniform by stabilizing the plasmas.

The DC voltage at 300–500 V is applied to the surface in contact with the vanes, because the voltage within this range is efficient for converting the hydrogen sulfide gas, the nitrogen gas and the hydrogen gas into plasmas by the glow discharge. If the voltage is lower than 300V, plasma conversion can not be taken place sufficiently and, on the other hand, if it exceeds 500 V, localized over heating is caused on the surface of the metal member or the nitrosulphurization with uniform thickness or hardness can not be conducted, which is not undesirable.

Figure 6:
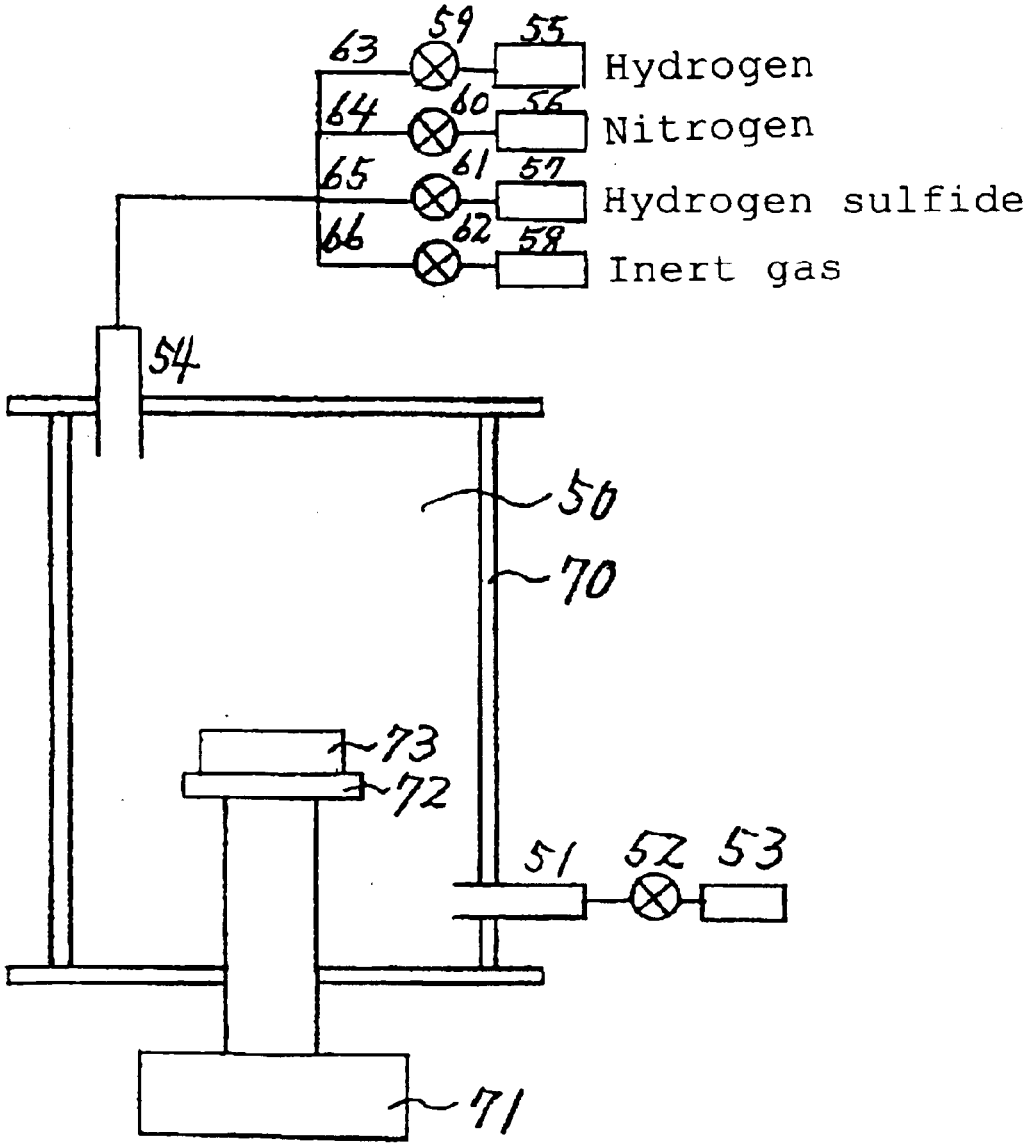
FIG. 6 is a schematic view for a nitridation device of a bright nitrogen diffusion method used for practicing the embodiment of this invention.

It is necessary that the vacuum chamber used for the plasma nitrosulphurization comprise a glow discharge electrode and pipelines for plasma conversion gas, and an exhaust pipe in connection with a vacuum pump. FIG. 6 shows a schematic view for a nitrosulphurization apparatus by a bright nitrogen diffusion method used for practicing this invention. A heating heater 70 is disposed in the inside of an outer wall of a vacuum chamber 50. A DC electrode 72 connected with a DC power source 71 is disposed in the vacuum chamber 50. An exhaust pipe 51 is connected with a lower portion of the vacuum chamber 50 and it is connected by way of a pressure control valve 52 with a vacuum pump 53. A nozzle 54 for supplying starting gases is inserted through a upper portion of the vacuum chamber 50. Supply sources for inert gases such as $H_2$ gas, $H_2S$ (hydrogen sulfide), $N_2$ gas and Ar gas are connected, respectively; by way of mass flow controllers 55–58, control valves 59–62 and inlet pipes 63–66 to the nozzle 54. A surrounding member 73 made of SKD61 steels is disposed on the DC electrode 72.

EXAMPLE 1

Figure 7:
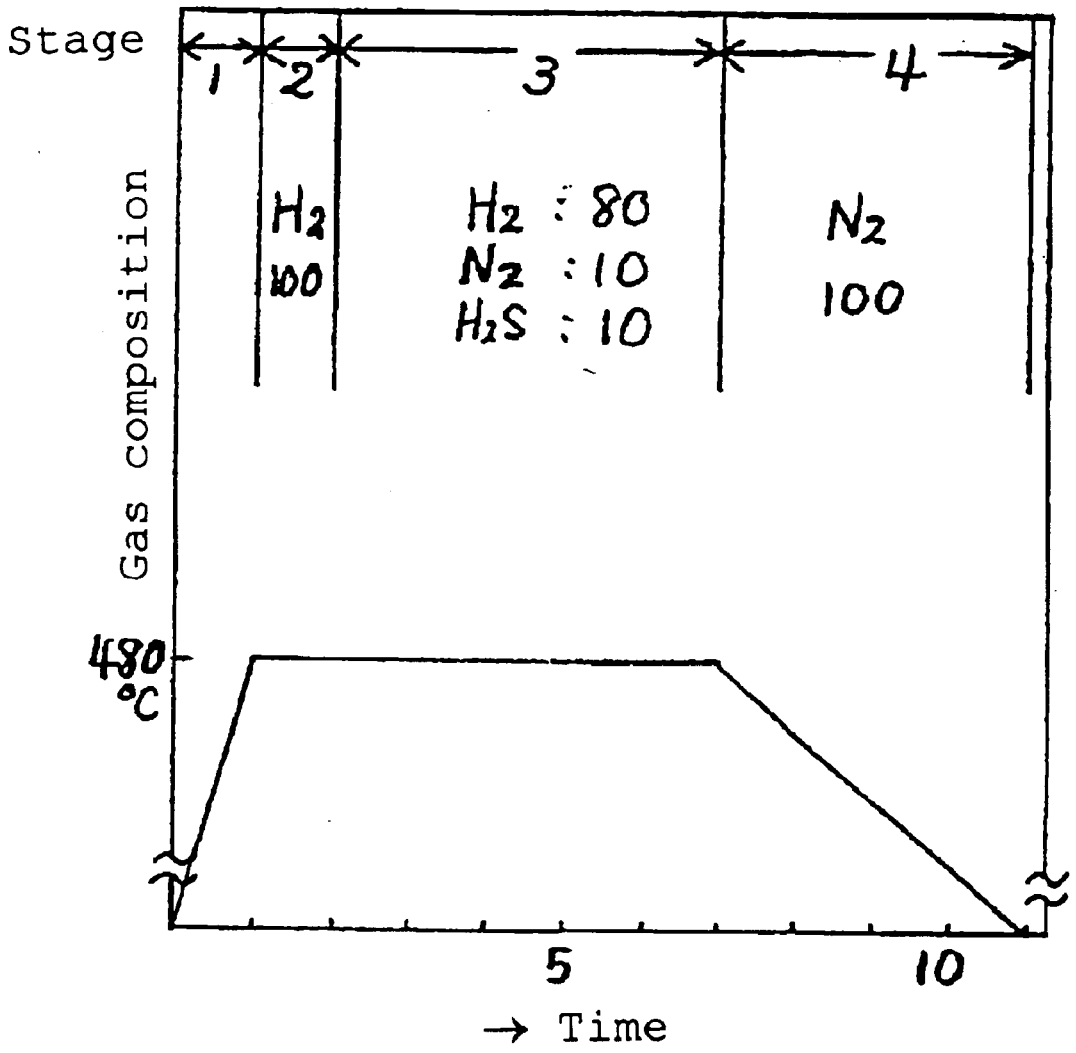
FIG. 7 is an example of a heating recycle curve in the nitridation treatment of the bright nitrogen diffusion method according to the embodiment of this invention.

A surrounding member 73 made of SKD61 steels was placed and secured on the DC electrode 72 in the vacuum chamber 50. Electric current was supplied to the outer wall heater of the vacuum chamber 50 and the inside of the vacuum chamber was heated along the heating cycle shown in FIG. 7 and, after elevating the temperature up to 480° C. for about one hour, it was kept at a temperature of 480±10° C. for 6 hours and then cooled down to a room temperature for about 4 hours. The gas composition in the vacuum chamber was changed for 1 to 4 stages of period divisionally as shown in FIG. 7. The first stage is a temperature elevation process in which only evacuation is conducted with no gas supply. The second stage is a cleaning process in which a gas comprising 100% hydrogen is supplied. The third stage is a nitrosulphurization diffusion process in which a gas mixture of a 80% hydrogen gas, a 10% nitrogen gas and a 10% hydrogen sulfide gas was supplied.

In the third stage, a DC voltage at 410 V was applied to the surrounding member 73 on the DC electrode 72 disposed in the vacuum chamber 50, gases were ionized by glow discharge and nitrogen and sulfur were diffused to the surface of the surrounding member 73. The fourth stage is a cooling process in which spontaneous cooling down to the room temperature is conducted in an atmosphere of 100% nitrogen.

Figure 8:
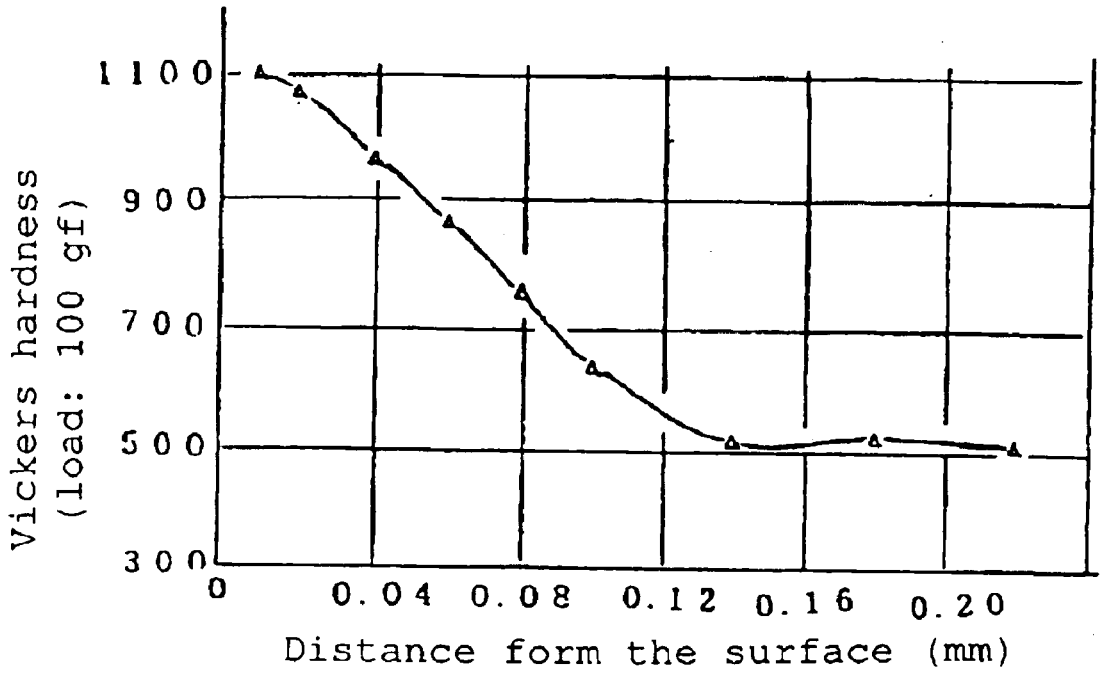
FIG. 8 shows an example of measured values for the Vickers hardness along the cross section of the nitrosulphurization layer after the bright nitrogen diffusion treatment according to the embodiment of this invention.

With the procedure, the mean value for the Vickers hardness at the unit area on the uppermost surface of the surrounding member (load: 100 gf) was 1100, the maximum value was 1150 and the minimum value was 1080. Further, it was confirmed in this case that a nitrosulphurization layer was formed from the uppermost surface to a depth of 0.14 mm of the surrounding member after treatment as shown in FIG. 8. The hardness of the nitrosulphurization layer was continuously decreased from the uppermost surface to the depth of 0.14 mm of the surrounding member and, further, a Vickers hardness (load: 100 gf) of 700 or more was obtained as far as the depth of 0.09 mm. As described above, since the nitrosulphurization layer was more hard and thick, the hardness of the nitrosulphurization layer was decreased continuously and the Vickers hardness at the surfaces was extremely uniform compared with the usual case, a nitrosulphurization layer excellent in adhesion with the steel matrix layer was formed.

EXAMPLES 2–5

Nitrosulphurization layers were formed on the surrounding members in the same manner as in Example 1 except for changing the partial pressure of the hydrogen gas, the nitrogen gas and the hydrogen sulfide gas and the application voltage. Other conditions than those described above were identical with those in Example 1.

COMPARATIVE EXAMPLE 1

Only the nitridation layer was formed in this case not using the hydrogen sulfide gas, the other conditions being identical with those in Example 1. In this case, since the value for a larger difference between the mean value and the maximum value or the minimum value of the Vickers hardness on the surface layer exceeded 100, somewhat unevenness was caused to the hardness.

Measured values in examples and comparative example are collectively shown in Table 1.

For the mean values in the examples and comparative example, test was conducted repeatedly by five times for the area of the uppermost surface of 1 $cm^2$ and their mean values were determined, and compared with the maximum value and the minimum value.

Treatment conditions and Vickers hardness on the surface of surrounding member

| | Treatment condition (Gas partial pressure) | | | Applied | Vickers hardness of surface | | | Vickers hardness at |
|---|---|---|---|---|---|---|---|---|
| | Hydrogen | Hydrogen sulfide | Nitrogen | voltage (V) | Mean value | Maximum value | Minimum value | 0.09 mm depth |
| Example 1 | 80 | 10 | 10 | 410 | 1100 | 1150 | 1080 | 700 or more |
| Example 2 | 80 | 5 | 15 | 410 | 1000 | 1100 | 950 | 700 or more |
| Example 3 | 80 | 15 | 5 | 410 | 1150 | 1180 | 990 | 700 or more |
| Example 4 | 80 | 10 | 10 | 380 | 1120 | 1150 | 1060 | 700 or more |
| Example 5 | 80 | 10 | 10 | 460 | 1100 | 1100 | 1060 | 700 or more |
| Comp. Example 1 | 80 | 0 | 20 | 410 | 1050 | 1160 | 880 | 700 or more |

INDUSTRIAL APPLICABILITY

In this invention, a nitrosulphurization layer having a Vickers hardness of 800 to 1200 Vickers hardness (load: 100 gf) is formed on the uppermost surface of a surrounding member of a vane motor by using a bright nitrogen diffusion method, the nitrosulphurization layer is more hard and thick than existent surrounding members for the vane motors and, since the hardness of the nitrosulphurization layer on the surfaces is uniform which is gradually decreased as it is remote from the surface, it is excellent in close adhesion with a steel matrix layer. Accordingly, while the endurance life of motor was only about 1500 hours for the existent surrounding member, the endurance life of the motor in the use of the vane motor by using the surrounding member according to this invention has been improved outstandingly as from 8,000 to 10,000 hours, and the motor life at least about 5 to 6 times the existent case can be obtained.

What is claimed is:

1. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein the surface is heated along a heating cycle comprising raising the temperature to about 480° C. over about one hour during which evacuation is conducted with no gas supply;

then maintaining said temperature of approximately 480° C. in the presence of hydrogen gas without nitrogen or hydrogen sulfide;

then adding nitrogen and hydrogen sulfide to provide a gas mixture of approximately 80% hydrogen, 10% nitrogen, and 10% hydrogen sulfide and applying said DC voltage; and then reducing the temperature over a period of about four hours in a nitrogen atmosphere substantially free of hydrogen and hydrogen sulfide, and the resultant nitrosulphurization layer has a thickness of about 0.14 mm and a surface Vickers hardness varying between 1080 and 1150.

2. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein any difference of Vickers hardness value between the mean value and either the maximum value or the minimum value is no greater than 100;

wherein the nitrosulfurization layer extends to a depth of 0.09 mm.

3. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein any difference of Vickers hardness value between the mean value and either the maximum value or the minimum value is no greater than 100;

wherein said Vickers hardness is 700 or more under a load of 100 gf, said hardness extending to a depth of 0.09 mm.

4. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein any difference of Vickers hardness value between the mean value and either the maximum value or the minimum value is no greater than 100;

wherein the hardness of the nitrosulfurization layer continuously decreases from a maximum on said surface to a depth of 0.14 mm.

5. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein the nitrosulfurization layer extends to a depth of 0.09 mm.

6. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein said Vickers hardness is 700 or more under a load of 100 gf, said hardness extending to a depth of 0.09 mm.

7. A member for air motors in which the surface thereof, having a complex shape, is heated at 450 to 580° C. in a mixed gas atmosphere comprising 50 to 95% of hydrogen, and 5–50% of nitrogen and hydrogen sulfide, a DC voltage at 300 to 500V is applied relative to an anode disposed in a vacuum chamber under reduced pressure and a nitrosulphurization layer having a substantially uniform thickness of about 30–300 μm is formed on the surface, with a Vickers hardness of 800–1200, by using a bright nitrogen diffusion method, wherein said member is at least one of a rotor, cylinder, a front cylinder cover, and a rear cylinder cover; and wherein the hardness of the nitrosulfurication layer continuously decreases from a maximum on said surface to a depth of 0.14 mm.

* * * * *